US009178257B2

(12) United States Patent
Shawley et al.

(10) Patent No.: US 9,178,257 B2
(45) Date of Patent: Nov. 3, 2015

(54) FIRST AND SECOND MICROSTRIP NETWORKS STACKED IN AN INVERTED ARRANGEMENT TO EACH OTHER USING AN INTEGRATED SUPPORT AND SHIELDING STRUCTURE

(71) Applicant: Anaren. Inc., East Syracuse, NY (US)

(72) Inventors: Benjamin Shawley, Chittenango, NY (US); Michael Enders, Jamesville, NY (US)

(73) Assignee: Anaren, Inc., E. Syracuse, NY (US)

( * ) Notice: Subject to any disclaimer, the term of this patent is extended or adjusted under 35 U.S.C. 154(b) by 190 days.

(21) Appl. No.: 13/803,975

(22) Filed: Mar. 14, 2013

(65) Prior Publication Data

US 2014/0159828 A1 Jun. 12, 2014

Related U.S. Application Data

(60) Provisional application No. 61/733,921, filed on Dec. 6, 2012.

(51) Int. Cl.
*H01P 3/08* (2006.01)

(52) U.S. Cl.
CPC ..... *H01P 3/088* (2013.01); *H01P 3/084* (2013.01)

(58) Field of Classification Search
CPC ..... H01P 3/006; H01P 3/003; H01P 3/081; H01P 3/082; H01P 3/084; H01P 3/085; H01P 3/087; H01P 3/088
USPC ..... 333/238, 246, 1
See application file for complete search history.

(56) References Cited

U.S. PATENT DOCUMENTS

| | | | | |
|---|---|---|---|---|
| 2,754,484 | A * | 7/1956 | Adams | 333/99 R |
| 3,904,997 | A * | 9/1975 | Stinehelfer, Sr. | 333/116 |
| 4,801,905 | A | 1/1989 | Becker | |
| 5,354,951 | A | 10/1994 | Lange, Sr. | |
| 6,097,260 | A * | 8/2000 | Whybrew et al. | 333/1 |
| 6,888,427 | B2 * | 5/2005 | Sinsheimer et al. | 333/238 |
| 7,423,498 | B2 | 9/2008 | Dalconzo | |

FOREIGN PATENT DOCUMENTS

| | | |
|---|---|---|
| EP | 1906485 | 2/2008 |

* cited by examiner

*Primary Examiner* — Benny Lee
(74) *Attorney, Agent, or Firm* — Frederick J.M. Price; Daniel P. Malley; Bond Schoeneck & King, PLLC

(57) ABSTRACT

An assembly includes at least one first microstrip network having at least one first transmission line disposed on a first surface of a first dielectric layer including a first ground plane disposed on a second surface of the dielectric layer. At least one second microstrip network includes at least one second transmission line disposed on a first surface of a second dielectric layer, the second dielectric layer including a second ground plane disposed on a second surface of the second dielectric layer. The at least one second microstrip network is inverted relative to the at least one first microstrip network. At least one integrated support and shielding (ISS) structure is disposed between the second and the first microstrip network. The ISS structure includes a first cavity accommodating the first microstrip network and a second cavity accommodating the second microstrip network. The cavities are configured in accordance with RF performance criterions.

14 Claims, 2 Drawing Sheets

FIRST AND SECOND MICROSTRIP NETWORKS STACKED IN AN INVERTED ARRANGEMENT TO EACH OTHER USING AN INTEGRATED SUPPORT AND SHIELDING STRUCTURE

RELATED APPLICATION DATA

The present application claims the benefit of U.S. provisional patent application No. 61/733,921, filed Dec. 5, 2012, and is hereby incorporated by reference in its entirety.

BACKGROUND OF THE INVENTION

1. Field of the Invention

The present invention relates generally to RF circuits, and particularly to RF circuits and shielding structures.

2. Technical Background

Referring to FIG. 1, a cross-sectional view of a stylized conventional microstrip circuit 10 is depicted. The microstrip circuit 10 includes a dielectric layer 14 having microstrip layer 16 disposed on the top of the dielectric layer 14. A metallized ground layer 12 is disposed on the underside of the dielectric layer 14. As those of ordinary skill in the art will appreciate, the microstrip circuit 10 may be employed to implement distributed element filters. Stated differently, as the operating frequency increases, lumped elements become impractical and filter components are realized with transmission line components (i.e., distributed elements). The metallized layers (12, 16) may be implemented using any suitable materials such as copper, gold, silver, etc. The dielectric layer 14 may also be implemented using any suitable material such as FR-4, alumina, etc.

One drawback associated with the microstrip network 10 relates to its ability to propagate electromagnetic signals into the surrounding RF environment. The electromagnetic signals emanating from the microstrip network 10, for example, can be unintentionally received and conducted by other networks operating in the same environment and thus interfere with these networks. Thus, the signals generated by the microstrip lines would be interpreted as noise or interference signals. Moreover, in a system that employs multiple microstrip circuits in close proximity to each other, cross-coupling of the electromagnetic signal may occur, resulting in crosstalk between adjacent microstrip transmission lines.

In reference to FIG. 2, a cross-sectional view of the circuit depicted in FIG. 1 with a conventional shielding structure 18 is shown. Thus, in one approach that has been considered, multiple microstrip filters may be disposed adjacent to each other in an array on the same plane with some type of shielding structure disposed therebetween. (For clarity and simplicity of illustration, only one microstrip network 10 is shown in FIG. 2). One drawback to this approach is that it is not spatially efficient in terms of the overall footprint because it requires multiple microstrip networks 10 disposed side-by-side and adjacent to each other (As implied by FIG. 2). Stated differently, this approach often requires a large surface area and is thus not suitable for miniaturized applications. This approach is also often unpractical for highly integrated applications for the same reasons.

In another approach that has been considered, stripline filters have been employed in multi-layered structures to reduce the footprint and achieve a higher degree of integration. One drawback to this approach is that often, an entire set of filters has to be designed and manufactured at the same time and lack modularity. Moreover, stripline technology often has a limited pool of material choices and may present increased manufacturing uncertainties relative to simpler technologies due to the characteristics of the specific bonding processes used in stripline technology. For example, comparable microstrip circuits do not have such limitations and are thus relatively inexpensive when compared to stripline circuits.

What is needed, therefore, is an integrated support and shielding structure that can be used in conjunction with a plurality of microstrip circuits without interference, crosstalk or any of the other drawbacks described above.

SUMMARY OF THE INVENTION

The present invention addresses the needs described above by providing an Integrated Support and Shielding (ISS) structure that applies to the design of two or more stacked RF/microwave microstrip filters. The ISS structure of the present invention provides structural support and electromagnetic shielding to both microstrip circuits. The ISS structure is designed such that parasitic resonance modes and effective shield heights are incorporated into the anticipated design performance. Dielectric materials, resonant structures and filter topologies are chosen based on the desired performance.

The present invention provides higher filter density within a given dimensional footprint as compared to traditional design and implementation methods of microstrip filters. The present invention allows microstrip filters, which are planar structures, to be placed directly on top of each other while maintaining typical microstrip filter performance and manufacturing ease. The ISS structure of the present invention advantageously provides shielding for the top and bottom microstrip filters while simultaneously providing support for the top microstrip structure. The ISS structure exhibits an H-shaped structure that provides air cavities for each microstrip filter within the shielded enclosure.

One aspect of the present invention is directed to an assembly that includes at least one first microstrip network having at least one first transmission line disposed on a first surface of a first dielectric layer. The first dielectric layer includes a first ground plane disposed on a second surface of the dielectric layer. At least one second microstrip network includes at least one second transmission line disposed on a first surface of a second dielectric layer, the second dielectric layer including a second ground plane disposed on a second surface of the second dielectric layer. The at least one second microstrip network is inverted relative to the at least one first microstrip network. At least one integrated support and shielding (ISS) structure is disposed between the at least one second microstrip network and the at least one first microstrip network. The ISS structure includes a first cavity accommodating the at least one first microstrip network and a second cavity accommodating at least one second microstrip network. The first cavity is configured in accordance with at least one RF performance criterion associated with the at least one first microstrip network. The second cavity is configured in accordance with at least one RF performance criterion associated with the at least one second microstrip network.

In another aspect, the invention also includes at least one interconnection device disposed between the at least one second microstrip network and the at least one first microstrip network.

Additional features and advantages of the invention will be set forth in the detailed description which follows, and in part will be readily apparent to those skilled in the art from that description or recognized by practicing the invention as described herein, including the detailed description which follows, the claims, as well as the appended drawings.

It is to be understood that both the foregoing general description and the following detailed description are merely exemplary of the invention, and are intended to provide an overview or framework for understanding the nature and character of the invention as it is claimed. The accompanying drawings are included to provide a further understanding of the invention, and are incorporated in and constitute a part of this specification. The drawings illustrate various embodiments of the invention, and together with the description serve to explain the principles and operation of the invention.

DETAILED DESCRIPTION OF THE INVENTION

Figure 1:
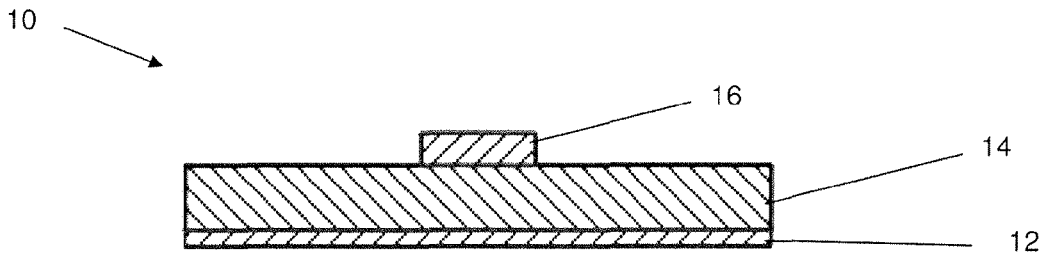
Fig. 1 PRIOR ART
FIG. 1 is a cross-sectional view of a stylized conventional microstrip circuit.
Figure 2:
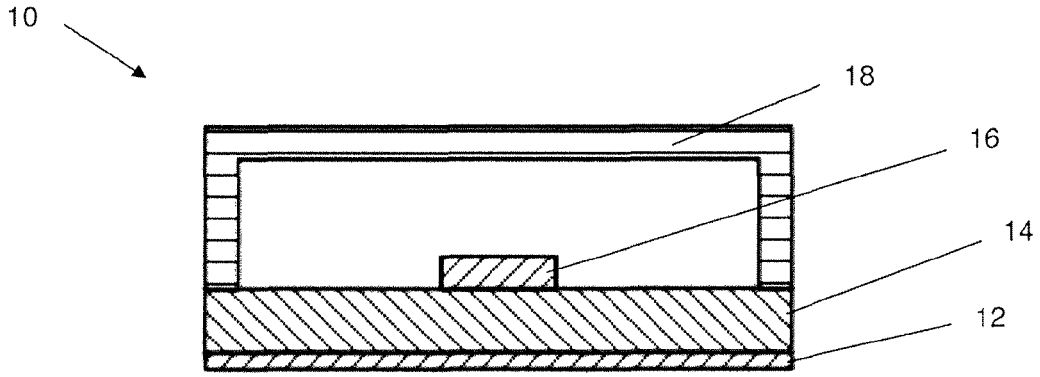
Figure 2 PRIOR ART
FIG. 2 is a cross-sectional view of the circuit depicted in FIG. 1 with a shielding structure disposed on the top of the circuit.

Reference will now be made in detail to the present exemplary embodiments of the invention, examples of which are illustrated in the accompanying drawings. Wherever possible, the same reference numbers will be used throughout the drawings to refer to the same or like parts. An exemplary embodiment of the integrated support and shielding (ISS) structure of the present invention is shown in FIG. 3, and is designated generally throughout by reference numeral 20.

Figure 3:
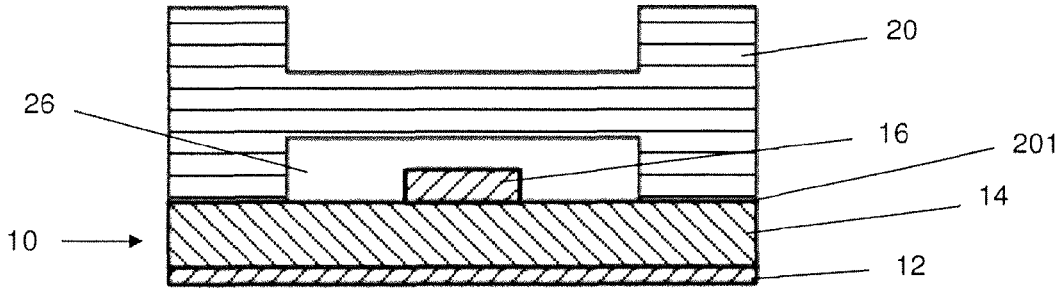
FIG. 3 is a cross-sectional view of a microstrip circuit protected by an integrated support and shielding structure in accordance with an embodiment of the present invention.

As embodied herein, and depicted in FIG. 3, a cross-sectional view of a microstrip circuit 10 protected by an integrated support and shielding (ISS) structure 20 in accordance with an embodiment of the present invention is disclosed. As before, the microstrip circuit 10 includes a dielectric layer 14 having microstrip layer 16 disposed on the top of the dielectric layer 14. A metallized ground layer 12 is disposed on the underside of the dielectric layer 14. However, the conventional shielding structure 18 is replaced by the H-shaped ISS structure 20 of the present invention. The ISS structure 20 is coupled to the dielectric material 14 by any suitable means 201 such as by an epoxy material or solder. The bottom portion of the ISS structure 20 provides a lower cavity 26 that accommodates the first microstrip circuit 10.

Figure 4:
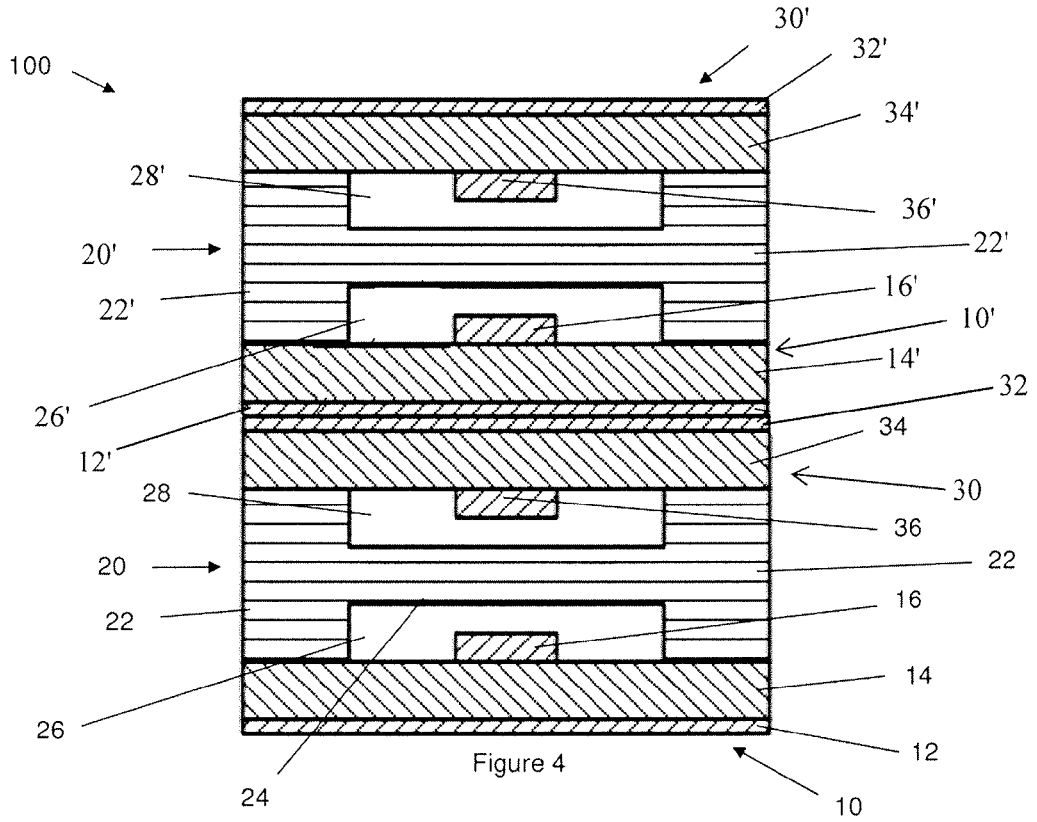
FIG. 4 is a cross-sectional view of stacked microstrip circuits with an integrated support and shielding structure in accordance with the present invention.

Referring to FIG. 4, a cross-sectional view of an RF assembly 100 that includes stacked microstrip circuits (10, 30, 10' and 30') with ISS structure 20 and ISS structure 20', respectively, in accordance with the present invention is disclosed. In this view, a second microstrip filter network 30 is disposed on the top portion of the H-shaped ISS structure 20, and a fourth microstrip filter network 30' is disposed on the top portion of a second H-shaped ISS structure 20'. Thus, a dielectric layer 34/34' is disposed on the vertical sidewalls 22/22' of the ISS structure 20/20' such that the microstrip layer 36/36' is inverted relative to the microstrip network 10/10' and disposed within the upper cavity 28/28' of the ISS structure 20/20'. Also, shown in FIG. 4 are a metalized ground layer 12', a dielectric layer 14', a microstrip layer 16', a cavity 26' and a dielectric surface 32'. A person skilled in the art will appreciate, therefore, that the dielectric layer of a third microstrip filter network 10' (as shown in this view) may be disposed on the top of ground plane 32 to provide another microstrip filter layer. Moreover, the present invention may accommodate however many microstrip network layers that a particular design calls for.

Referring back to FIG. 4, the embodiment depicted therein includes two microstrip filters (10, 30). Each filter (10, 30) may be realized using any suitable dielectric material including, but not limited to, FR-4, Alumina, or high frequency laminates. In addition, other high dielectric constant materials such as titanium dioxide, magnesium-titanium (Mg—Ti) or barium-titanium (Ba—Ti) alloys, etc. may be employed.

In addition, the ISS structure 20 can be realized by machining a single piece of metallic material (e.g., aluminum). This embodiment is preferred when the filter structures (10, 30) require extremely precise shielding heights and widths. However, this approach may not be the most economical one and may not be required to obtain the desired performance. For example, the use of a stamped or formed fence-cover-fence structure realizes lower costs and assembly ease (albeit by sacrificing boundary precision). During the design and tuning of the filters (10, 30) the dimensions of the ISS structure 20 are incorporated into the electrical performance modeling. Including the ISS structure 20 within the electrical simulations allows any parasitic effects, such as coupling, to be accurately modeled. Although it is possible not to completely simulate the effect of the ISS structure 20, it is often required to obtain the desired performance. After simulation and manufacturing of the filter and ISS structure, the individual pieces are assembled together as shown in FIGS. 3 and 4.

Figure 5:
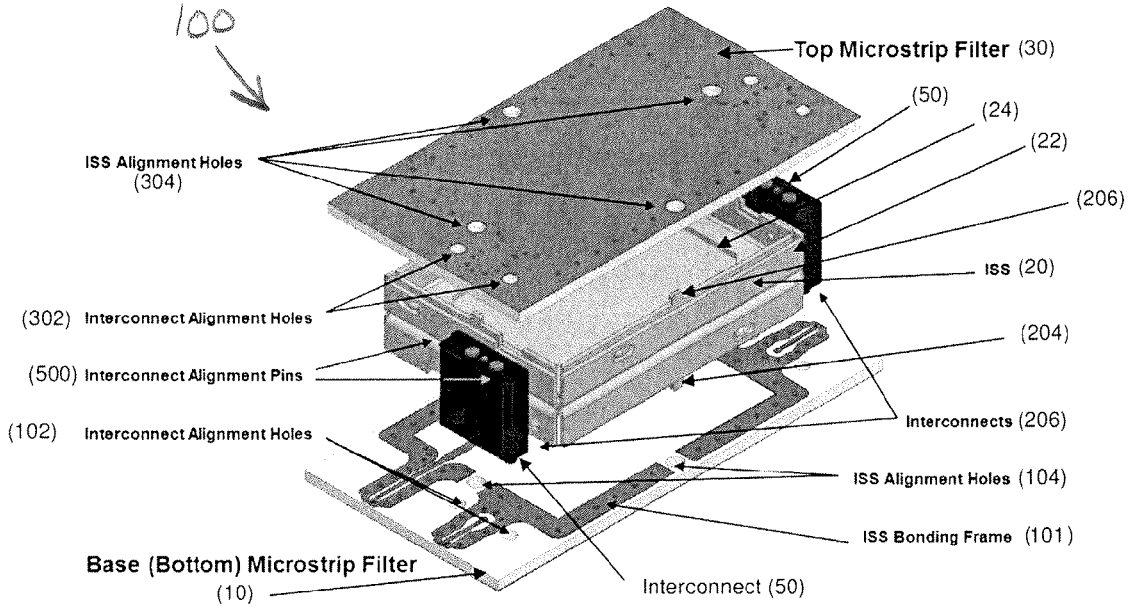
FIG. 5 is a perspective detail view of the stacked microstrip circuits with an integrated support and shielding structure in accordance with an embodiment of the present invention.

As embodied herein and depicted in FIG. 5, a perspective detail view of an RF assembly 100 that includes the stacked microstrip filter circuits (10, 30) with an integrated support and shielding ISS structure 20 in accordance with another embodiment of the present invention is disclosed. In this embodiment an RF interconnector 50 is coupled to the sidewall 22 of the ISS structure 20 between the first filter network 10 and the second filter network 30. The dielectric material 14 (see FIG. 4) of the first filter network 10 includes a bonding frame 101 that is used to bond the ISS structure 20 to the surface of the dielectric material 14. Of course, a similar material is disposed on dielectric 34 (see FIG. 4) for the same purpose. The dielectric planes (12, 32) of FIG. 4 also include interconnect alignment holes (102, 302) that are configured to receive the alignment pins 500 from the interconnector 50. Both of the ground planes (12, 32) also include ISS alignment holes (104, 304) that are configured to receive respective ISS interconnection pins 204, 206.

The RF interconnect 50 provides a means for propagating the RF signals between the microstrip layers (10, 30). The RF interconnect may be implemented using any suitable device such as miniature blindmate connectors. The RF interconnects 50, as shown, can also be implemented using a Ground-Signal-Ground (GSG) interconnect or coaxial interconnect. For proper wideband filter performance, it is preferable that the performance of the interconnect be considered when creating the upper microstrip artwork.

Moreover, the ISS structure 20 may be coupled or bonded to the RF substrates (12, 32) using any suitable attachment method that provides sufficient retention force for the intended environmental application. This includes, but is not limited to, mechanical screws, epoxy, or solder. RF connections with the RF assembly 100 of the present invention may be made using any suitable means such as wire bonds or blindmate connectors.

As noted previously, the present invention employs multiple alignment mechanisms to positively locate the bottom and top microstrip structures. Feature location is critical for proper alignment and performance of both the individual filters (10, 30) as well as the RF interconnects 50. The feature locations, and the tolerances associated with them, are used within the filter simulations to predict proper performance. While preliminary simulations can be made of the microstrip filters without the effects of the ISS structure, interconnects, and location features, additional simulations which include all impacts of these modeled features should be performed.

The embodiments of the invention presented above are only two of the various implementations possible using the stacked microstrip assembly 100 of the present invention. In another embodiment of the present invention, the RF signal transitions are incorporated into the ISS structure. This may be advantageous during the assembly process of the entire structure.

Another embodiment of the present invention is directed to an ISS structure and attachment method that provides a lower thermal resistance path to the mounting structure for better thermal dissipation in higher power filter applications. In another embodiment of the present invention, the ISS structure includes multiple cavities on each side thereof; this feature allows for the use of multiple filters on each dielectric layer (10, 30). While this structure may in some cases provide only a slight saving in footprint when compared to building separate assemblies 100, it more importantly accommodates an entire set of filters on a single assembly.

As noted above, another embodiment of the present invention provides for the stacking of multiple layers by attaching multiple of the filter-ISS-filter sets on top of each other and having RF interconnects 50 of various lengths to reach the different levels. This allows for higher footprint density at the cost of increased height requirements.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening.

The recitation of ranges of values herein are merely intended to serve as a shorthand method of referring individually to each separate value falling within the range, unless otherwise indicated herein, and each separate value is incorporated into the specification as if it were individually recited herein.

All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not impose a limitation on the scope of the invention unless otherwise claimed.

No language in the specification should be construed as indicating any non-claimed element as essential to the practice of the invention.

It will be apparent to those skilled in the art that various modifications and variations can be made to the present invention without departing from the spirit and scope of the invention. There is no intention to limit the invention to the specific form or forms disclosed, but on the contrary, the intention is to cover all modifications, alternative constructions, and equivalents falling within the spirit and scope of the invention, as defined in the appended claims. Thus, it is intended that the present invention cover the modifications and variations of this invention provided they come within the scope of the appended claims and their equivalents.

What is claimed is:

1. An assembly comprising:

at least one first microstrip network including at least one first transmission line disposed on a first surface of a first dielectric layer, the first dielectric layer including a first ground plane disposed on a second surface of the first dielectric layer;

at least one second microstrip network including at least one second transmission line disposed on a first surface of a second dielectric layer, the second dielectric layer including a second ground plane disposed on a second surface of the second dielectric layer, the at least one second microstrip network being inverted relative to the at least one first microstrip network;

at least one integrated support and shielding (ISS) structure disposed between the at least one second microstrip network and the at least one first microstrip network, the ISS structure including a first cavity accommodating the at least one first microstrip network and a second cavity accommodating at least one second microstrip network; and wherein the first dielectric layer and the second dielectric layer are made from different dielectric materials.

2. The assembly of claim 1, wherein at least one of said first dielectric layer and said second dielectric layer further comprises at least one alignment portion on the first surface thereof, wherein said alignment portion is configured receive an alignment pin from said at least one ISS structure.

3. The assembly of claim 1, wherein at least one of the first surface of said first dielectric layer and the first surface of said second dielectric layer further comprises a bonding frame, wherein said bonding frame is structured to bond said at least one ISS structure to at least one of said first surface of said first dielectric layer and said second dielectric layer.

4. The assembly of claim 1, wherein said at least one ISS structure is coupled to each of said at least one second microstrip network and said at least one first microstrip network by an attachment means.

5. The assembly of claim 1, further comprising at least one interconnection device disposed between the at least one second microstrip network and the at least one first microstrip network.

6. The assembly of claim 5, wherein at least one of said first dielectric layer and said second dielectric layer further comprises at least one alignment portion on the first surface thereof, wherein said alignment portion is configured receive an alignment pin from said at least one interconnection device.

7. The assembly of claim 5, wherein said at least one interconnection device is configured to propagate RF signals between said at least one first microstrip network and said at least one second microstrip network, and is implemented using an interconnector.

8. The assembly of claim 1, wherein each of said dielectric layer is formed from a dielectric material selected from the group consisting of FR-4, Alumina, high frequency laminates, titanium dioxide, magnesium-titanium alloys, and barium-titanium alloys.

9. The assembly of claim 1, further comprising:

at least one third microstrip network disposed on top of said at least one second microstrip network and including at least one third transmission line disposed on a first surface of a third dielectric layer, the third dielectric layer including a third ground plane disposed on a second surface of the third dielectric layer.

10. The assembly of claim 9, further comprising:

at least one fourth microstrip network including at least one fourth transmission line disposed on a first surface of a fourth dielectric layer, the fourth dielectric layer including a fourth ground plane disposed on a second surface of the second dielectric layer, the at least one fourth microstrip network being inverted relative to the at least one third microstrip network.

11. The assembly of claim 10, further comprising a second ISS structure disposed between the at least one fourth microstrip network and the at least one third microstrip network, the second ISS structure including a third cavity accommodating the at least one third microstrip network and a fourth cavity accommodating at least one fourth microstrip network.

12. The assembly of claim 1, further comprising:

at least one third microstrip network laterally positioned to said at least one first microstrip network and including at least one third transmission line disposed on a first surface of a third dielectric layer, the third dielectric layer including a third ground plane disposed on a second surface of the third dielectric layer.

13. The assembly of claim 12, further comprising:

at least one fourth microstrip network including at least one fourth transmission line disposed on a first surface of a fourth dielectric layer, the fourth dielectric layer including a fourth ground plane disposed on a second surface of the second dielectric layer, the at least one fourth microstrip network being inverted relative to the at least one third microstrip network.

14. The assembly of claim 13, further comprising a second ISS structure disposed between the at least one fourth microstrip network and the at least one third microstrip network, the second ISS structure including a third cavity accommodating the at least one third microstrip network and a fourth cavity accommodating at least one fourth microstrip network.

* * * * *